US008770840B2

(12) United States Patent
Liao et al.

(10) Patent No.: US 8,770,840 B2
(45) Date of Patent: Jul. 8, 2014

(54) AIRBAG STRUCTURE WITH INNER SHADE COVER AND MANUFACTURING METHOD THEREOF

(76) Inventors: Yaw Shin Liao, New Taipei (TW); Chieh Hua Liao, New Taipei (TW); Ting Yu Liao, New Taipei (TW)

( * ) Notice: Subject to any disclaimer, the term of this patent is extended or adjusted under 35 U.S.C. 154(b) by 233 days.

(21) Appl. No.: 13/270,243

(22) Filed: Oct. 11, 2011

(65) Prior Publication Data

US 2013/0089279 A1 Apr. 11, 2013

(51) Int. Cl.

| | |
|---|---|
| ***B65D 30/00*** | (2006.01) |
| ***B65D 33/16*** | (2006.01) |
| ***B65D 33/00*** | (2006.01) |
| ***B65D 30/08*** | (2006.01) |
| ***B65D 81/02*** | (2006.01) |

(52) U.S. Cl.
USPC ..... 383/3; 383/61.1; 383/94; 383/98; 383/113; 206/522

(58) Field of Classification Search
USPC ..... 383/3, 61.1, 94, 98, 99, 110, 113; 206/522
See application file for complete search history.

(56) References Cited

U.S. PATENT DOCUMENTS

| | | | | |
|---|---|---|---|---|
| 2,087,611 | A * | 7/1937 | Wells, Jr. et al. | 383/61.1 |
| 4,679,242 | A * | 7/1987 | Brockhaus | 383/4 |
| 4,679,688 | A * | 7/1987 | Soderholm et al. | 206/204 |
| 6,238,091 | B1 * | 5/2001 | Mogil | 383/110 |
| 6,513,974 | B2 * | 2/2003 | Malone et al. | 383/3 |
| 7,631,762 | B2 * | 12/2009 | Liao et al. | 206/522 |
| 2008/0260303 | A1 * | 10/2008 | De Lesseux et al. | 383/110 |

* cited by examiner

*Primary Examiner* — Jes F Pascua

(57) ABSTRACT

In an airbag structure with an inner shade cover and a manufacturing method of the airbag, a first plastic plate and a second plastic plate are stacked in parallel with each other, and the first plastic plate is formed by a plurality of air-column plates, and the air-column plate includes a plurality of nodes, and the second plastic plate is stained with a dark dye for sheltering an external light, and then both ends of the first and second plastic plates are hot sealed, and then the first and second plastic plates are folded simultaneously along the nodes, so that the first plastic plate forms a bag, and the second plastic plate is covered onto an inner side of the bag, so that the second plastic plate forms a plastic inner cover.

5 Claims, 8 Drawing Sheets

(A-A)

AIRBAG STRUCTURE WITH INNER SHADE COVER AND MANUFACTURING METHOD THEREOF

FIELD OF THE INVENTION

The present invention relates to an airbag structure with an inner shade cover, in particular to a bag capable of avoiding light exposure and protecting a fragile object, and the bag has air-column plates and nodes formed on the bag and a plastic inner cover stained with a dark dye and covered onto the inner side of the bag, and also relates to a manufacturing method of the airbag structure.

BACKGROUND OF THE INVENTION

At present, transparent airbags have been used extensively for packaging fragile objects, such that when the object is impacted by external forces, the airbags can provide a buffering effect to prevent damages to the object.

In a conventional transparent airbag structure as disclosed in R.O.C. Pat. No. I330613, a bag body of a packaging bag is comprised of a plurality of air-column plates, and the bag body is divided into a seat portion, a bottle body portion, a bottleneck portion, and a handle portion, wherein the seat portion, the bottle body portion, the bottleneck portion and the handle portion are divided to form a plurality of air columns with a buffering effect, such that the air-column plates can be wrapped around the object to provide vibration absorbing and buffering effects to prevent the object from being broken or damaged during transportation.

In addition, objects such as electronic or optoelectronic components or carbon powder cartridge are generally packaged into a dark plastic bag for sheltering external light from projecting onto these components and protecting the object from damages caused by external forces. The dark plastic bag is generally packed into a transparent airbag to further protect the object in the dark plastic bag from being damaged by external forces. For example, a transparent airbag of repeated use as disclosed in U.S. Pat. No. 7,201,273B2 comprises an extended air-column plate capable of covering a pocket of the bag. However, the packaging bag is transparent, so that it is necessary to pack the object into a black plastic bag and seal the black plastic bag before placing the object into the bag to prevent external lights from projecting onto the object. Therefore, the requirements for preventing light exposure and providing the buffering effect cannot be achieved in a single manufacturing procedure, and additional packaging materials are required, and thus failing to comply with the environmental protection requirements.

In addition, P.R.C. Pat. No. 200810094091.4 also discloses an air suspending shockproof bag having hanging plastic plates installed within surrounding air columns of the bag, and the hanging plastic plates installed in the bag provide a U-shaped containing space for placing an object. After the bag is sealed, it is necessary to damage the air columns of the bag to remove the object inside the bag, so that the whole bag is usually discarded after use.

SUMMARY OF THE INVENTION

Therefore, it is a primary objective of the present invention to overcome the problems of the conventional way of repeatedly packaging an object by using a dark plastic bag and a transparent airbag that incurs a more complicated manufacturing procedure and consumes additional packaging materials.

To achieve the foregoing objective, the present invention provides an airbag structure with an inner shade cover, comprising:

a bag, comprised of a plurality of air-column plates, and the air-column plate having a plurality of nodes provided for folding the air-column plates into the bag, and the bag having a containing space formed therein, and a pocket formed on the bag and interconnected to the containing space;

a plastic inner cover, attached on an inner wall of the containing space, for covering an object placed in the containing space, and the plastic inner cover being stained with a dark dye to shelter an external light from projecting onto the object, and the plastic inner cover having a cover opening interconnected to the interior of the plastic inner cover, and one or more extension plates extended from the cover opening to the outside through the pocket for repeated sealing and cutting-open jobs; and one or more extended air-column plates, disposed at the external periphery of the pocket, and including one or more air-column plates and a plurality of nodes for folding the air-column plates, such that the extended air-column plate can cover the pocket.

From the description above, an object that requires avoiding light exposures can be put into the containing space from the pocket, and through the cover opening into the plastic inner cover, and then the extension plates of the cover opening are stacked to cover the pocket, such that the plastic inner cover can be sealed, and then the air-column plates of the bag are inflated. Since the extended air-column plates have the nodes for folding, therefore the extended air-column plates can be bent naturally to cover the pocket of the bag, so as to provide a buffering effect for the object in the plastic inner cover and increase the volume of the bag. If it is necessary to remove the object from the bag for a rework, the sealing position of the cover opening of the plastic inner cover is cut open, and the object is removed from the bag for a rework, and then the reworked object is put into plastic inner cover again from the cover opening, and the sealing position of the cover opening is sealed again.

Therefore, the plastic inner cover can be used to seal the object and prevent electrostatic charges from affecting the object, as well as sheltering external lights from projecting on the object, and providing a buffering and shock resisting protection to the object by using the air-column plates of the bag. In addition, the sealed plastic inner cover can be cut open for several times and the object can be packaged again without affecting the buffering effect of the air-column plates of the bag, so as to achieve repeated uses without damaging the bag, so as to save unnecessary manufacturing procedure and packaging material and comply with the environmental protection requirements.

The air-column plate is formed by hot sealing two plastic films into a plurality of directionally or non-directionally arranged air columns, and the bag is inflated, so that the air columns can produce a buffering effect. The air columns are disposed on lateral sides and the bottom of the bag respectively, and the area of some of the air columns can be decreased or increased according to the sharpness of the object to prevent the object from being pierced and broken by the object, so as to improve the buffering effect.

In a preferred embodiment, the nodes are arranged to form a node line, and the shape, size or area of the node can be adjusted to form and change a folding position of the air-column plate. The extension plates of the cover opening are formed at symmetrical positions at the external periphery of the cover opening respectively.

In another preferred embodiment, the extended air-column plates are installed at symmetrical positions at the external periphery of the pocket, and a rear end of the extended air-column plate can be hooked up with hot air, if needed to form a sealed or non-sealed connection, or the rear end of the extended air-column plate is not hooked up with hot air to facilitate removing the object in the plastic inner cover. Two nodes can be added to the extended air-column plate, so that the extended air-column plate can be folded into three sections. After the extended air-column plate is inflated, the extended-column plate is folded along the nodes or bent into an n-shape or a U-shape, and the n-shaped or U-shaped extended air-column plate can be bent towards the pocket to cover the pocket automatically.

In a further preferred embodiment, the plastic inner cover and the bag are coupled through a hot sealing line, so that the plastic inner cover is attached closely onto the inner wall of the containing space.

In addition, the present invention further provides a manufacturing method of an airbag with an inner shade cover, comprising the steps of:

parallelly stacking a first plastic plate with a second plastic plate, wherein the first plastic plate is comprised of a plurality of air-column plates, and each air-column plate has a plurality of nodes formed thereon, and the second plastic plate is stained with a dark dye for sheltering an external light;

hot-sealing both ends of the first plastic plate and the second plastic plate, so that both ends of the first plastic plate and the second plastic plate are coupled with each other; and simultaneously folding the first plastic plate and second plastic plate folding along the nodes, so that the first plastic plate forms a bag, and covering the second plastic plate onto an inner side of the bag, so that the second plastic plate forms a plastic inner cover.

The manufacturing method of the present invention further comprising the step of: forming a containing space on an inner side of the first plastic plate, a pocket formed at a position proximate to both ends of the first plastic plate and interconnected to the containing space, and attaching the second plastic plate onto an inner wall of the containing space, and forming a cover opening at a position proximate to both ends of the second plastic plate and interconnected to the plastic inner cover.

An end of the second plastic plate is extended to an outer side of the first plastic plate, and an extension plate is extended from the pocket to the outside for repeated sealing and cutting-open jobs, or both ends of the second plastic plate are extended to outer sides of both ends of the first plastic plate respectively, and extended to the outside through the pocket for repeated sealing and cutting-open jobs.

An extended air-column plate is extended from an end of the first plastic plate through the external periphery of the pocket and comprises one or more air-column plates and a plurality of nodes for folding the air-column plates, such that the extended air-column plate can cover the pocket, or an extended air-column plate is formed at both ends of the first plastic plate and extended through the external periphery of the pocket and comprises one or more air-column plates and a plurality of nodes for folding the air-column plates, and the extended air-column plate covers the pocket.

The extended air-column plate is folded along the nodes and bent into an n-shape or a U-shape.

DESCRIPTION OF THE PREFERRED EMBODIMENTS

Figure 1:
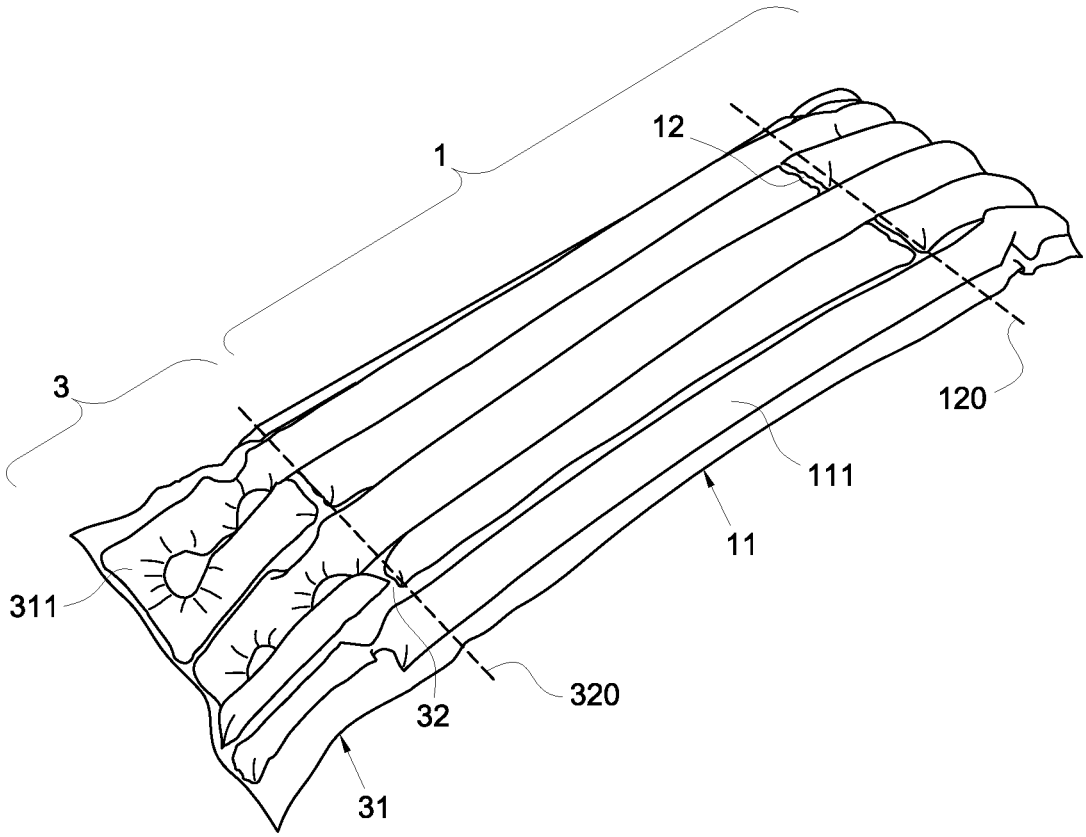
FIG. 1 is a perspective view of an airbag structure in accordance with a first preferred embodiment of the present invention.
Figure 2:
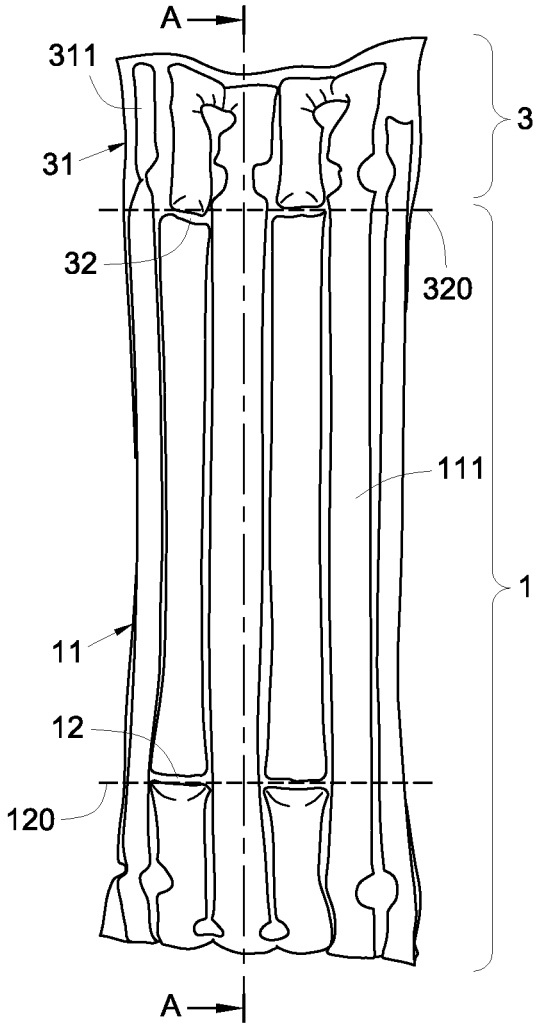
FIG. 2 is a top view of FIG. 1.
Figure 3:
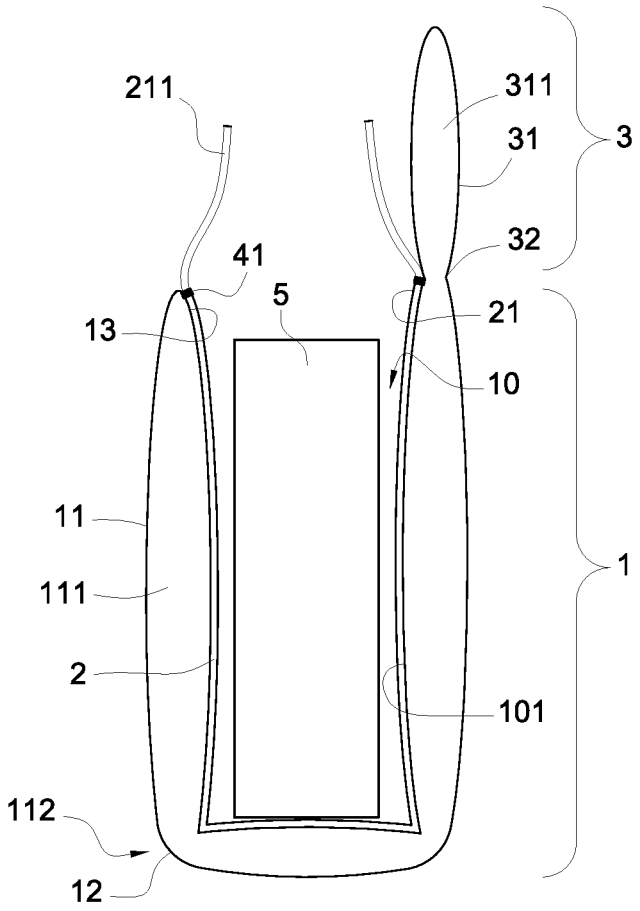
FIG. 3 is a cross-sectional view of an application of the preferred embodiment as depicted in FIG. 1.

With reference to FIGS. 1 to 3 for a perspective view, a top view and a cross-sectional view of an airbag structure with an inner shade cover in accordance with the first preferred embodiment of the present invention respectively, the airbag structure comprises a bag 1, a plastic inner cover 2 and one or more extended air-column plates 3; the bag 1 is composed of a plurality of air-column plates 11, and the air-column plate 11 includes a plurality of nodes 12 formed thereon and provided for folding the air-column plates 11 to form the bag 1, and the bag 1 has a containing space 10 formed therein and a pocket 13 formed at the top of the bag 1 and interconnected to the containing space 10.

The plastic inner cover 2 is attached on an inner wall 101 of the containing space 10 and capable of covering an object 5 in the containing space 10, and the plastic inner cover 2 is stained with a dark dye for sheltering external light that may be projected onto the object 5 in the containing space 10, and the plastic inner cover 2 has a cover opening 21 formed at the top of the plastic inner cover 2 and interconnected to the interior of the plastic inner cover 2, and one or more extension plates 211 are extended outwardly from the cover opening 21 to the outside through the pocket 13 and are spaced apart from the extended air-column plate 3 so as to freely bend for the purpose of repeated sealing and cutting-open jobs. The plastic inner cover 2 can be stained with a dark dye by the following methods. The dark dye is coated on an external surface of the plastic inner cover 2, or the dark dye is added into a plastic material for forming the plastic inner cover 2 during the process of forming the plastic inner cover 2.

Figure 5:
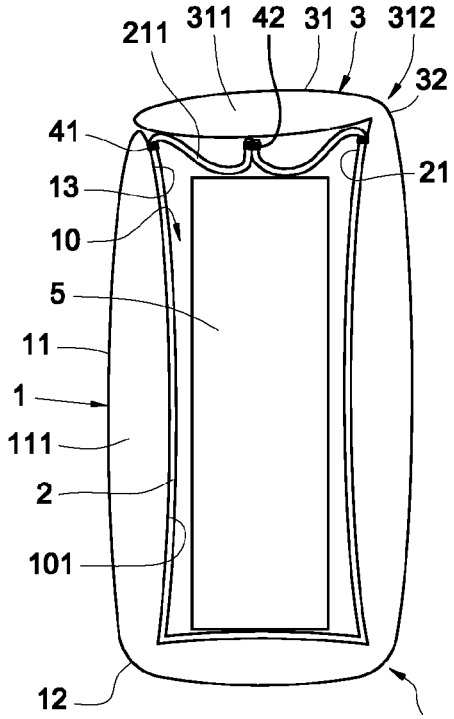
FIG. 5 is a cross-sectional view of another further application as depicted in FIG. 4.

The extended air-column plate 3 is situated at an external periphery of the pocket 13 and comprises one or more air-column plates 31 and a plurality of nodes 32 for folding the air-column plates 31, so that the nodes 32 can be used for folding the extended air-column plate 3 to cover the pocket 13 (as shown in FIG. 5) to further provide the buffering effect for the object 5 in the plastic inner cover 2 of the containing space 10.

Specifically, the present invention comprises the following elements:

The bag 1 and the air-column plates 11, 31 of the extended air-column plate 3 are formed by heat sealing two plastic films into a plurality of directionally or non-directionally arranged air-column plates 111, 311, and the air columns 111, 311 are interconnected to one another, such that the bag 1 can be inflated to provide a buffer effect by the air columns 111, 311. The air columns 111 are formed on the lateral sides and the bottom of the bag 1, and some area of the air column 111 can be increased or decreased according to the sharpness of the object 5 to prevent the air column 111 from being pierced or broken by the object 5, so as to improve the buffering effect.

Figure 4:
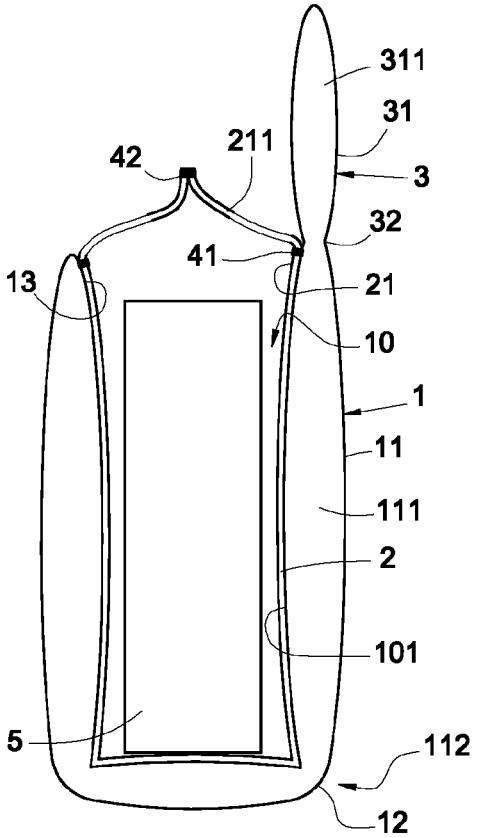
FIG. 4 is a cross-sectional view of another application as depicted in FIG. 3.

The nodes 12, 32 of the bag 1 and the extended air-column plate 3 are arranged into a node line 120, 320 separately, so that the shape, size or area of the nodes 12, 32 can be adjusted to from and change a folding position 112, 312 of the air column 111, 311. In this preferred embodiment, there are two extension plates 211 of the cover opening 21 and formed at symmetrical positions at the external periphery of the cover opening 21, and the extension plates 211 can be stacked with each other to seal the cover opening 21 (as shown in FIG. 4), and the extension plates 211 can be integrally formed with the plastic inner cover 2, so that the extension plate 211 is also stained with a dark dye, and the extension plate 211 can shelter the external light from projecting through the pocket 13 and the cover opening 21 into the containing space 10 and the plastic inner cover 2.

The extended air-column plate 3 can be integrally formed with the bag 1, and there is one extended air-column plate 3 adopted in this preferred embodiment.

The plastic inner cover 2 and an inner wall of the containing space 10 of the bag 1 are coupled by a hot sealing line 41, so that the plastic inner cover 2 is attached closely onto the inner wall 101 of the containing space 10 of the bag 1. In this preferred embodiment, a hot sealing line 41 is formed between both sides of the pocket 13 and the plastic inner cover 2 by a hot sealing process, so that the plastic inner cover 2 can be fixed onto the inner wall 101 of the containing space 10 more securely.

With the aforementioned components, the present invention can be achieved, and users can put an object 5 that requires avoiding a light exposure from the pocket 13 into the containing space 10 and from the cover opening 21 into the plastic inner cover 2, and then the rear end of the extension plate 211 of the plastic inner cover 2 is hot pressed, so that a hot sealing line 42 is formed at the hot pressed position at the rear end of the extension plate 211 for sealing the cover opening 21 to prevent an external light from projecting through the cover opening 21 onto the object 5. Now, the air-column plate 11 of the bag 1 is inflated, so that the inflated gas enters from the air columns 111 of the bag 1 into the air-column plate 31 of the extended air-column plate 3 to fill up the air columns 111, 311 with air. Since the extended air-column plate 3 has a plurality of nodes 32 for the folding purpose, therefore the extended air-column plate can be folded along the node line 320 and bent in a direction towards the pocket 13 to cover the pocket 13 of the bag 1, and the extended air-column plate 3 can cover the pocket 13. As a result, the air-column plate 311 of the extended air-column plate 3 is capable of providing a buffering effect at the pocket 13.

By placing the object 5 into the plastic inner cover 2 with the sealing, moisture resisting and static charge resisting effects, and wrapping the object 5 completely by the air columns 111, 311 around the containing space 10, the buffering and shock resisting effects can be achieved to minimize the damage rate. In addition, the bag 1 is normally in a flat shape, and the bag 1 can be inflated anytime for its use, so that the bag 1 does not occupy much space.

If it is necessary to remove the object 5 from the bag 1 for a rework, the extended air-column plate 3 can be lifted to open the pocket 13, and then the hot sealing line 42 of the extension plate 211 of the plastic inner cover 2 is cut to open the cover opening 21, and the object 5 is removed for the rework operation, and then the object 5 is put into the plastic inner cover 2 through the cut sealing position of the cover opening 21, and the cut sealing position of the cover opening 21 is hot sealed again to package the object 5 into the bag 1 and the plastic inner cover 2 again, so that the bag 1 can be used repeatedly.

Therefore, the present invention can seal the object 5 by means of the plastic inner cover 2 to prevent the object 5 from being affected by electrostatic charges, while sheltering an external light from projecting onto the object 5, as well as using the air columns 111, 311 of the bag 1 to provide the buffering and shock resisting effects to the object 5. In addition, the sealed plastic inner cover 2 can be cut open for many times, and the object 5 can be packaged again without affecting the buffering effect of the air columns 111, 311 of the bag 1 to achieve the effect of repeated uses without damaging the bag 1, so as to save the manufacturing procedure and packaging material and comply with the environmental protection requirements.

Figure 6:
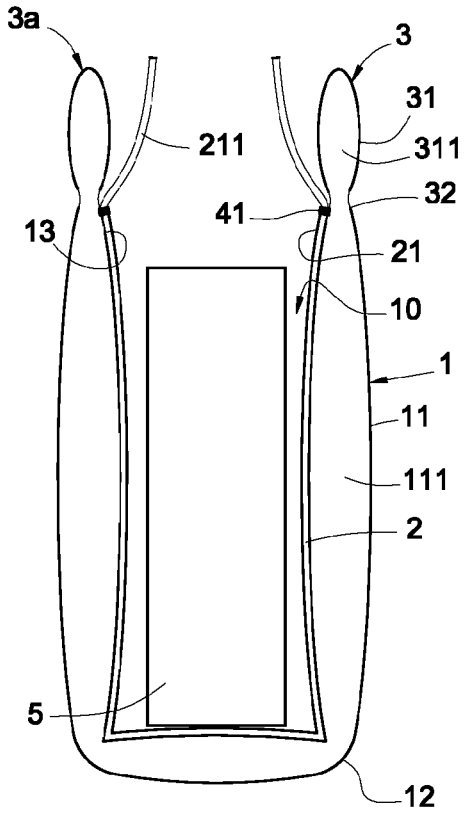
FIG. 6 is a cross-sectional view of an airbag structure in accordance with a second preferred embodiment of the present invention.
Figure 7:
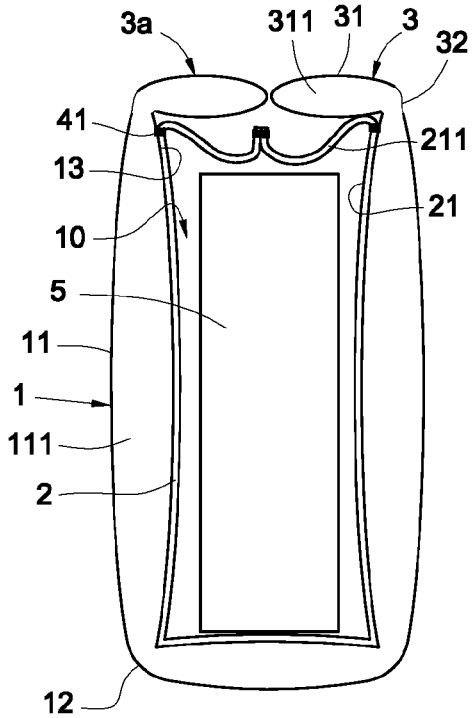
FIG. 7 is a cross-sectional view of an application as depicted in FIG. 6.

With reference to FIGS. 6 and 7 for a cross-sectional view of a second preferred embodiment of the present invention and a cross-sectional view of an application as depicted in FIG. 6 respectively, the difference between this preferred embodiment and the first preferred embodiment resides on that there are two extended air-column plates 3, 3*a* installed at symmetrical positions of the external periphery of the pocket 13 respectively, and the extended air-column plate 3, 3*a* can be coupled to each other to cover the pocket 13, so that the extended air-column plates 3, 3*a* can be coupled to form a space to increase the volume of the bag 1. The assembly of the remaining components and the implementation method of this preferred embodiment are the same as those of the first preferred embodiment.

Figure 8:
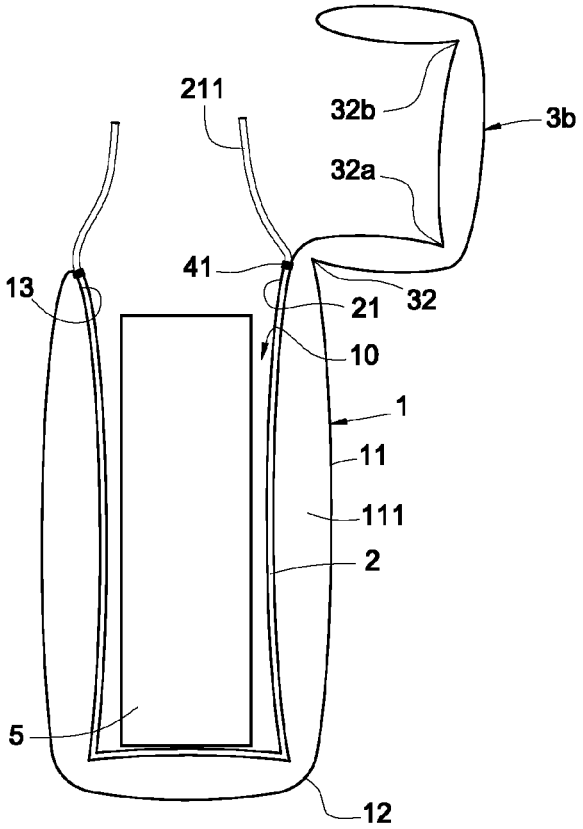
FIG. 8 is a cross-sectional view of an airbag structure in accordance with a third preferred embodiment of the present invention.
Figure 9:
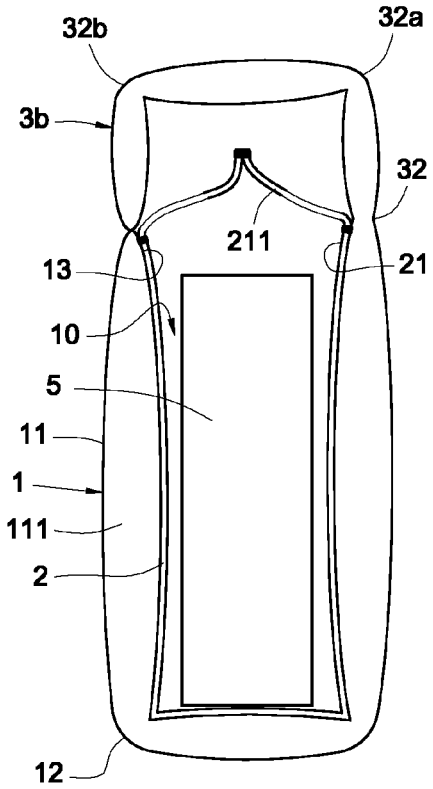
FIG. 9 is a cross-sectional view of an application as depicted in FIG. 8.
Figure 10:
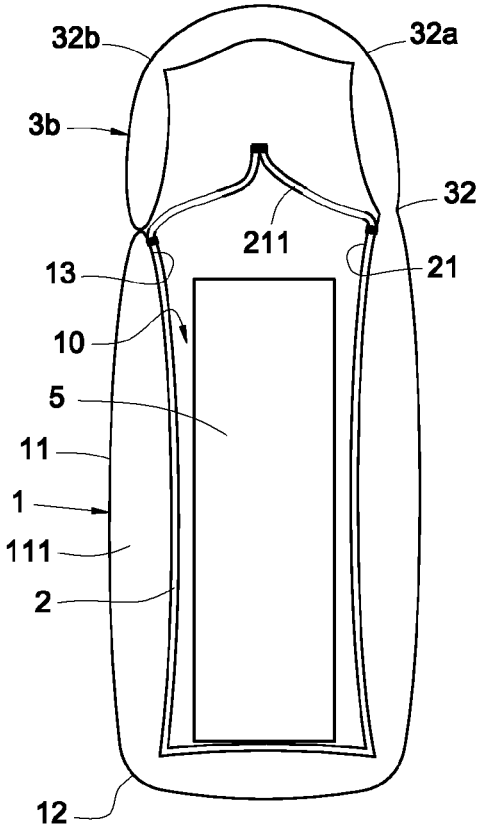
FIG. 10 is a cross-sectional view of another application as depicted in FIG. 8.

With reference to FIGS. 8 and 9 for a cross-sectional view of a third preferred embodiment of the present invention and a cross-sectional view of an application in accordance with the third preferred embodiment of the present invention respectively, the difference between this preferred embodiment and the first preferred embodiment resides on that two nodes 32*a*, 32*b* are added to the extended air-column plate 3*b*, so that the extended air-column plate 3*b* can be folded into three sections, and after the extended air-column plate 3*b* is inflated and folded along the nodes 32*a*, 32*b* into an n-shape or U-shape (as shown in FIG. 10), the n-shaped or U-shaped extended air-column plate 3*b* can be folded towards the pocket 13 cover the pocket 13. The assembly of the remaining components and the implementation method of this preferred embodiment are the same as those of the first preferred embodiment.

Figure 11:
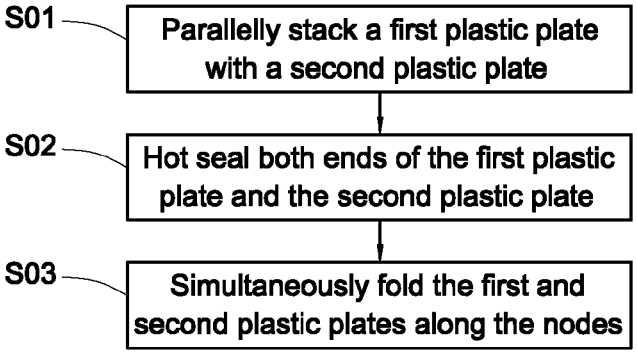
FIG. 11 is a flow chart of a manufacturing method of an airbag in accordance with the present invention airbag.
Figure 12:
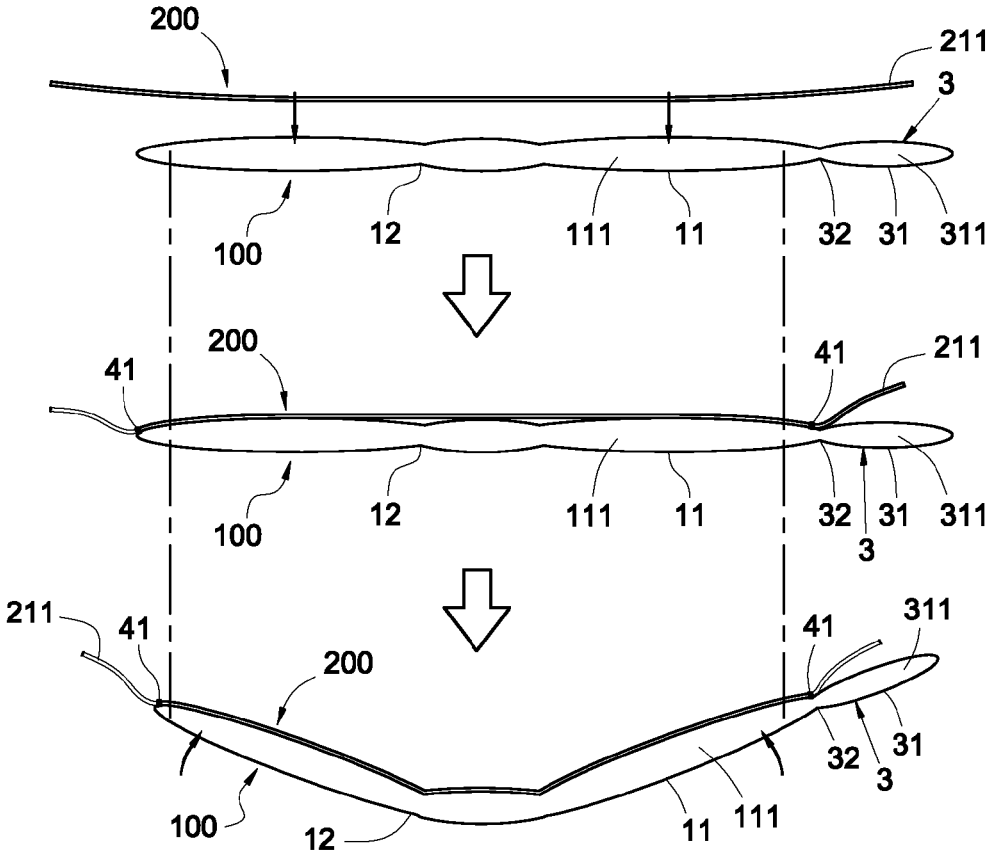
FIG. 12 is a schematic view, showing the steps of the method as depicted in FIG. 11.

With reference to FIGS. 11 and 12 for a flow chart of a manufacturing method of an airbag in accordance with the present invention airbag; and a schematic view, showing the steps of the method as depicted in FIG. 11 respectively, the manufacturing method of the present invention comprises the following steps:

S01: Parallely stack a first plastic plate 100 with a second plastic plate 200, wherein the first plastic plate 100 is comprised of a plurality of air-column plates 11, and the air-column plate 11 includes a plurality of nodes 12, 32, and the second plastic plate 200 is stained with a dark dye for sheltering an external light.

S02: Hot seal both ends of the first plastic plate 100 and the second plastic plate 200, such that both ends of the first and second plastic plates 100, 200 are welded to form the hot sealing line 41, and both ends of the first and second plastic plates 100, 200 are coupled to each other.

S03: Simultaneously fold the first and second plastic plates 100, 200 along the nodes 12, 32, so that the first plastic plate 100 forms the bag 1 (as shown in FIG. 3), and the second plastic plate 200 is covered onto an inner side of the bag 1, so that the second plastic plate 200 forms the plastic inner cover 2. Wherein, the first plastic plate 100 has the containing space 10 formed therein, and the pocket 13 is formed at a position proximate to both ends of the first plastic plate 100, and the second plastic plate 200 is attached on an inner wall 101 of the containing space 10, and the cover opening 21 is formed at a position proximate to both ends of the second plastic plate 200, and the hot sealing line 41 is disposed precisely at both sides of the pocket 13 and the cover opening 21.

An end of the second plastic plate 200 is extended to an outer side of an end of the first plastic plate 100 and extended through the pocket 13 to the outside to form the extension plate 211. In this preferred embodiment, both ends of the second plastic plate 200 are extended to outer sides of both ends of the first plastic plate 100 respectively, and extended through the pocket 13 to the outside to form the extension plate 211.

An end of the first plastic plate 100 is extended from the external periphery of the pocket 13 to form the extended air-column plate 3 comprising the air-column plate 31 and node 32, so that the extended air-column plate 3 can covers the pocket 13, or both ends of the first plastic plate 100 can be extended from the external periphery of the pocket 13 to form the extended air-column plates 3, 3*a* (as shown in FIGS. 6 and 7) and comprises the air-column plate 31 and the node 32, so that the extended air-column plates 3, 3*a* can cover the pocket 13.

The extended air-column plate 3*b* is folded along the nodes 32*a*, 32*b* and bent into an n-shape or a U-shape (as shown in FIGS. 9 and 10) to manufacture the aforementioned airbag structure with an inner shade cover, and the assembly of the remaining components and the implementation method are the same as the aforementioned preferred embodiments.

What is claimed is:

1. An airbag structure with an inner shade cover, comprising:

a bag, comprised of a plurality of air-column plates and a plurality of air columns formed at lateral sides and a bottom of the bag respectively, and the air-column plate having a plurality of nodes provided for folding the air-column plates into the bag, and the bag, having a containing space formed therein, and a pocket formed on the bag and interconnected to the containing space, the plurality of air columns being interconnected to one another by being inflated to provide a buffer effect;

a plastic inner cover, attached on an inner wall of the containing space of the bag by a hot sealing line, for covering an object placed in the containing space, and the plastic inner cover being stained with a dark dye to shelter an external light from projecting onto the object, and the plastic inner cover having a cover opening formed at a top of the plastic inner cover and interconnected to the interior of the plastic inner cover, and at least one extension plate extended from the cover opening to the outside through the pocket; and at least one extended air-column plate, disposed at the external periphery of the pocket, and including one or more air-column plates and a plurality of nodes for folding the air-column plates, such that the at least one extended air-column plate can cover the pocket;

wherein the hot sealing line is formed on the cover opening, and the at least one extension plate is spaced apart from the at least one extended air-column plate so that the at least one extension plate is capable of freely bending to repeatedly sealing and opening the entire cover opening, the plastic inner cover having two extension plates, rear ends of the two extension plates being hot pressed with a hot sealing line for sealing the cover opening to prevent an external light from projecting through the cover opening onto the object.

2. The airbag structure with an inner shade cover as recited in claim 1, wherein the air-column plate is formed by hot sealing two plastic films into a plurality of directionally or non-directionally arranged air columns.

3. The airbag structure with an inner shade cover as recited in claim 1, wherein the nodes are arranged into a node line, and are configured to form a folding position determined by shapes, sizes and area of the nodes, where the air-column plate starts to fold from the folding position.

4. The airbag structure with an inner shade cover as recited in claim 1, wherein the extended air-column plate is folded along the nodes and bent into an n-shape or a U-shape.

5. The airbag structure with an inner shade cover as recited in claim 1, wherein the hot sealing line is disposed at both sides of the pocket and the cover opening in the containing space.

* * * * *